US007806345B2

(12) United States Patent
Tsunekawa et al.

(10) Patent No.: US 7,806,345 B2
(45) Date of Patent: Oct. 5, 2010

(54) IN-WALL HEATER

(75) Inventors: Ikuo Tsunekawa, Nagoya (JP); Minoru Oguri, Nagoya (JP); Satoshi Kaneiwa, Nagoya (JP); Brian Smith, Auckland (NL); Gregory Brinsden, Auckland (NL)

(73) Assignees: Rinnai Corporation, Nagoya-shi (JP); Rinnai New Zealand Ltd., Auckland (NZ)

( * ) Notice: Subject to any disclaimer, the term of this patent is extended or adjusted under 35 U.S.C. 154(b) by 1331 days.

(21) Appl. No.: 11/298,661

(22) Filed: Dec. 12, 2005

(65) Prior Publication Data

US 2006/0137678 A1 Jun. 29, 2006

(30) Foreign Application Priority Data

Dec. 27, 2004 (JP) ..... 2004-376684

(51) Int. Cl.

| | |
|---|---|
| ***F24C 15/06*** | (2006.01) |
| *F24C 15/22* | (2006.01) |
| *F24C 3/00* | (2006.01) |
| *F24C 3/04* | (2006.01) |
| *F23J 11/00* | (2006.01) |

(52) U.S. Cl. ..... 237/49; 237/52; 237/53; 237/55; 126/500; 126/507; 126/512; 126/521; 126/523

(58) Field of Classification Search ..... 237/49, 237/50, 52, 53, 55; 48/113; 110/162, 317; 126/21 R, 61, 67, 72, 77, 85 R, 116 R, 190, 126/193, 198, 500, 502, 503, 507, 512, 515, 126/516, 521–525, 528, 529, 531, 544, 545, 126/549; 454/43, 324; *F23J 11/00; F24C 3/00, F24C 3/04, 15/06, 15/22*

See application file for complete search history.

(56) References Cited

U.S. PATENT DOCUMENTS

| | | | | | |
|---|---|---|---|---|---|
| 1,782,711 | A | * | 11/1930 | Callahan | 165/54 |
| 3,175,552 | A | * | 3/1965 | Sutton | 392/307 |
| 3,952,721 | A | * | 4/1976 | Patterson | 126/506 |
| 4,096,849 | A | * | 6/1978 | Moncrieff-Yeates | 126/529 |
| 4,129,113 | A | * | 12/1978 | Bergstrom | 126/522 |
| 4,271,815 | A | * | 6/1981 | Johnson | 126/517 |
| 4,386,599 | A | * | 6/1983 | Berryhill | 126/506 |
| 4,446,848 | A | * | 5/1984 | Becker et al. | 126/521 |
| 4,475,531 | A | * | 10/1984 | Gerhart | 126/521 |
| 4,607,611 | A | * | 8/1986 | Rice et al. | 126/531 |
| 5,014,684 | A | * | 5/1991 | Meeker | 126/531 |

(Continued)

FOREIGN PATENT DOCUMENTS

| | | | |
|---|---|---|---|
| GB | 2112128 | A * | 7/1983 |
| GB | 2231141 | A * | 11/1990 |
| GB | 2317224 | A * | 3/1998 |
| JP | 5-37129 | | 9/1993 |
| JP | 6-69602 | | 9/1994 |
| JP | 2006183917 | A * | 7/2006 |
| JP | 2006183918 | A * | 7/2006 |
| JP | 2006183919 | A * | 7/2006 |
| JP | 2007170752 | A * | 7/2007 |

*Primary Examiner*—Steven B McAllister
*Assistant Examiner*—Daniel E Namay
(74) *Attorney, Agent, or Firm*—Edwards Angell Palmer & Dodge LLP

(57) ABSTRACT

In an in-wall heater, in which control equipment 11, 12 is disposed in a side space 10 on one lateral side of a combustion housing 2 within an outer case 1 and an exhaust duct 15 is disposed in a side space 13 on the other lateral side of the combustion housing 2, the cooling performance of each of the side spaces is increased and noise due to a sucked-in sound of room air can be reduced. In a side plate portion of the outer case 1 on both lateral sides, an air intake opening 7, which is vertically long, is provided in a position in a front side portion exposed to a front of a room wall. Each side space 10, 13 within the outer case 1 is formed in a ventilation flue on the suction side where the room air from each of the air intake openings 7 is conducted into the warm air fan 9.

10 Claims, 11 Drawing Sheets

U.S. PATENT DOCUMENTS 5,038,754 A * 8/1991 Scala ..... 126/521
5,092,518 A * 3/1992 Tomioka et al. ..... 236/10
5,139,011 A * 8/1992 Moon ..... 126/512
5,144,941 A * 9/1992 Saito et al. ..... 126/507
5,267,552 A * 12/1993 Squires et al. ..... 126/512
5,305,954 A * 4/1994 Abel ..... 237/55
5,772,423 A * 6/1998 Mandir ..... 431/254
5,931,154 A * 8/1999 Hussong et al. ..... 126/512
6,439,226 B1 * 8/2002 Johnson et al. ..... 126/547
6,736,133 B2 * 5/2004 Bachinski et al. ..... 126/521
2002/0083944 A1 * 7/2002 Darbonne, Sr. ..... 126/501
2003/0188736 A1 * 10/2003 Bachinski et al. ..... 126/521

* cited by examiner

IN-WALL HEATER

BACKGROUND OF THE INVENTION

1. Field of the Invention

The present invention relates to an in-wall heater which is disposed by being embedded in a recess formed in a room wall.

2. Description of the Related Art

As an in-wall heater of this kind, there has hitherto been known an in-wall heater which comprises an outer case, a combustion housing which is provided within the outer case and in which a burner is built, a heat exchanger which is provided within the outer case so as to be positioned behind the combustion housing and causes combustion exhaust gas from the combustion housing to flow, an air intake opening and a blast opening each provided in the outer case, a warm air fan within the outer case which sucks in room air from the air intake opening and sends the air into the room from the blast opening via a section where the heat exchanger is disposed, control equipment which is disposed in a side space on one lateral side between the outer case and the combustion housing within the outer case, and an exhaust duct downstream of the heat exchanger which is disposed in a side space on the other lateral side between the outer case and the combustion housing within the outer case (refer to the Japanese Utility Model Laid-Open No. 5-37129, for example).

In a usual on-floor heater, generally, an air intake opening is provided in the back surface of an outer case. In an in-wall heater, however, the outer case enters into the recess in a room wall and, therefore, it is impossible to suck in room air from the back surface side of the outer case. Therefore, in the above-described conventional in-wall heater, a bottom plate portion of the outer case is raised from the floor surface, the air intake opening is provided in the bottom plate portion, and the warm air fan is disposed behind this air intake opening. And the room air is sucked into the warm air fan from the air intake opening via the space below the combustion housing and the room air is sent from the warm air fan into the blast opening to an upper part of the front surface of the outer case via the section where the heat exchanger is disposed behind the combustion housing and the space above the combustion housing.

A filter is mounted on the air intake opening in order to prevent the entry of dust into the outer case and it is necessary to clean the filter by periodically detaching the filter. If the air intake opening is provided in the bottom plate portion of the outer case as in the above-described conventional in-wall heater, it is troublesome to attach and detach the filter and maintainability worsens.

In order to solve this problem, there is also known an in-wall heater in which an air intake opening is provided in a front surface of an outer case in addition to a blast opening (refer to the Japanese Utility Model Publication No. 6-69602, for example). In this in-wall heater, however, a suction sound generated when room air is sucked in from the air intake opening is radiated forward directly from the front surface of the outer case and the noise becomes large. Incidentally, also when an air intake opening is provided in a bottom plate portion of the outer case, a suction sound echoes in a space between the bottom plate portion and the floor surface and this echo is radiated to the front side of the heater, generating a relatively large noise.

When control equipment and an exhaust duct are disposed respectively in a side space on one lateral side and in a side space on the other side within the outer case as with the heater described in the Japanese Utility Model Laid-Open No. 5-37129, there is a fear that the temperature of the control equipment may rise due to the heat from the combustion housing, causing heat loss of the control equipment and, at the same time, there is a fear that the temperature in the side space on the other side may rise due to the heat from the combustion housing and the heat from the exhaust duct, causing overheating of the room wall.

In view of the above points, the present invention has as its object the provision of an in-wall heater which can suppress an increase in noise due to a suction sound without impairing maintainability and can ensure also cooling performance in side spaces within an outer case.

SUMMARY OF THE INVENTION

To achieve the above objects, the present invention provides an in-wall heater which is disposed in a recess formed in room wall. This in-wall heater comprises: an outer case; a combustion housing which is provided within the outer case and in which a burner is built; a heat exchanger which is provided within the outer case so as to be positioned behind the combustion housing and causes combustion exhaust gas from the combustion housing to flow; an air intake opening and a blast opening each provided in the outer case; a warm air fan within the outer case which sucks in room air from the air intake opening and sends the air into the room from the blast opening via a section where the heat exchanger is disposed; control equipment which is disposed in a side space on one lateral side between the outer case and the combustion housing within the outer case; and an exhaust duct downstream of the heat exchanger which is disposed in a side space on the other lateral side between the outer case and the combustion housing within the outer case, wherein a side plate portion of the outer case on both lateral sides, the air intake opening is provided so as to be positioned in a front side portion exposed to the front of the room wall and vertically long, and each of the side spaces within the outer case is formed in a ventilation flue on the suction side where the room air from each of the air intake openings is conducted to the warm air fan.

With the above-described construction, the section where the air intake opening is provided is exposed to the front of the room wall, and therefore, the filter can be easily attached and detached to and from the air intake opening and maintainability is not impaired. Because the air intake opening is provided in the side plate portion of the outer case, a suction sound is radiated to the side of the heater and the noise level of a suction sound in front of the heater decreases.

The room air which has flown in from the air intake opening of each side plate portion of the outer case flows through each side space within the outer case and is sucked by the warm air fan. Besides, because the air intake opening is vertically long, the room air flows in a wide region in the vertical direction of each of the side spaces, and each of the side spaces is effectively cooled by this airflow. Therefore, it is possible to positively prevent the overheating of the room wall due to a temperature rise in the side spaces and the occurrence of heat loss of the control equipment.

Incidentally, in order to improve the heating efficiency, it is preferred that the blast opening is provided in the lower part of the front surface of the outer case so that warm air is blown out in a position near the floor surface. In this case, it is also conceivable that the warm air fan is disposed below the section where the heat exchanger is disposed and that the room air which has passed through each of the side spaces within the outer case is sucked from above the section where the heat exchanger is disposed into the warm air fan via the section where the heat exchanger is disposed. With this method, however, the room air does not flow easily into the space above the combustion housing within the outer case where the temperature is apt to rise, and there is a possibility that the overheating of the room wall may occur due to a rise in the temperature of the top surface of the outer case. In contrast, when the warm air fan is disposed in the space above the combustion housing within the outer case, also the space above the combustion housing is effectively cooled and the overheating of the room wall due to a rise in the temperature of the top surface of the outer case is positively prevented.

In the case of a fireplace-type in-wall heater in which a glass plate is mounted on the front surface of the combustion housing and a window portion facing the glass plate is provided in the front panel which constitutes the front surface of the outer case so that the combustion condition within the combustion housing can be seen with eyes, the temperature of the panel portion becomes considerably high on the upper side of the window portion, and there is a fear that users may touch this panel portion and feel the heat.

In order to prevent such problem, it is preferred that as described above, the warm air fan is disposed in the space above the combustion housing within the outer case. And at the same time, it is preferred that a duct is provided on a back surface of a part of the front panel on the upper side of the window portion to be laterally long and define a ventilation flue, which is in communication with an upper part of at least one of the two air intake openings on both lateral sides of the outer case, between the duct and the front panel, and an air outlet positioned near a section where a fan motor driving the warm air fan is provided in the duct. Also it is preferred that the room air which has flown into the duct from the air intake opening is sucked into the warm air fan after passing through the ventilation flue and the section where the fan motor is disposed in this order.

With this construction, the panel portion on the upper side of the window portion is air cooled by the room air flowing through the duct and users do not feel the heat even when they touch this panel portion. Incidentally, the reason why the warm air fan is disposed in the space above the combustion housing is that the cooling performance of the space above the combustion housing is thereby increased and that the suction force of the room air via the duct is increased by shortening the distance between the warm air fan and the duct. The space above the combustion housing is a place in which the temperature conditions are severe to the fan motor and hence heat loss to the fan motor is apt to occur. However, when the above-described construction is adopted, the room air which has flown out of the air outlet of the duct is blown into the warm air fan via the section where the fan motor is disposed and, therefore, the fan motor is also effectively air cooled, thereby making it possible to prevent heat loss of the fan motor.

Incidentally, in order to cause the air to be sucked into the warm air fan via the section where the fan motor is disposed, it is preferred that the warm air fan is constituted by a sirocco fan which sucks in air from the axial direction. However, the shaft length of the warm air fan cannot be made very large in terms of strength and in a case where the lateral dimension of the heater is large, it is necessary that a pair of right and left warm air fan is juxtaposed in such a posture that the axial direction of each fan is laterally aligned. In this case, it is preferred that the common fan motor which drives the two warm air fans is disposed between the two warm air fans, that the air outlet is provided in the middle part of the duct in the lateral direction thereof, and that both lateral end portions of the duct is in communication with the upper part of the air intake opening on both lateral ends of the outer case.

With this construction, the room air from each of the right and left air intake openings passes through each of the right and left halves of the duct, then flows from the air outlet via the section where the fan motor is disposed, and is sucked into each of the right and left warm air fans from the motor side shaft end. Thus, the part of the front panel on the upper side of the window portion is positively cooled in the whole lateral region and, at the same time, the fan motor is also positively cooled.

Also, when the warm air fan is disposed in the space above the combustion housing within the outer case as described above, there is a possibility that heat loss to the fan motor due to the heat transfer from the combustion housing may occur. For this reason, it is preferred that a partition plate is disposed above the combustion housing to define a gap with a top surface of the combustion housing, the partition plate being in communication with the section where the heat exchanger is disposed, that the warm air fan and a fan motor which drives the warm air fan is mounted on the partition plate, and that at least part of air blown out of the warm air fan flow via the gap into the section where the heat exchanger is disposed.

With this construction, the air blown out of the warm air fan flows through the gap between the top surface of the combustion housing and the partition plate, and therefore the partition plate is air cooled with this air and the heat from the combustion housing is not transmitted any more to the fan motor mounted on the partition plate. Thus, the heat loss of the fan motor due to the heat transfer from the combustion housing can be positively prevented.

Incidentally, if the warm air fan is mounted on the partition plate in such a manner that the outlet of the warm air fan is opposed to the top surface of the combustion housing and the whole volume of the air blown out of the warm air fan passes through the gap and is caused to flow into the section where the heat exchanger is disposed, then the pressure loss in the gap increases and the air volume of the warm air sent from the blast opening to the room decreases. In contrast, the pressure loss in the gap decreases and a decrease in the air volume of the warm air can be prevented if the warm air fan is mounted on the partition plate in such a manner that an outlet of the warm air fan faces a part immediately above the section where the heat exchanger is disposed, and if a split-flow plate which conducts part of the air blown out of the outlet of the warm air fan into the gap is provided on a bottom surface of the partition plate.

When the lateral dimension of the heater is large, it is rational that on the partition plate, a pair of right and left warm air fan is mounted in such a posture that the axial direction of each fan is laterally aligned and that the common fan motor which drives the two warm air fans is disposed in a position between the two warm air fans. In this case, it is preferred that the split-flow plate is disposed on the bottom surface of the section where the fan motor of the partition plate is mounted, with two lateral ends thereof facing end portions of the outlets of the two warm fans on the fan motor side. With this construction, the air which is blown out of the end portions of the outlets of the two warm fans on the motor side is guided to the split-flow plate and flows along the bottom surface of the partition plate in the section where the fan motor is mounted. For this reason, the bottom surface of the partition plate in the section where the fan motor is mounted can be efficiently air cooled.

Incidentally, in order to forcedly suck the combustion exhaust gas within the combustion housing via the heat exchanger, there is a case where the exhaust duct is connected to the heat exchanger via an exhaust fan. In this case, the fan motor which drives the exhaust fan is apt to be overheated because the heat of combustion exhaust gas is transferred in addition to the heat generation of the motor itself and hence the cooling of the fan motor becomes necessary. If the warm air fan in the space above the combustion housing within the outer case is disposed as described above and at the same time if the side space on the other lateral side within the outer case is partitioned into a lower space below the exhaust duct and an upper space where the exhaust duct is disposed and there is provided an air-conducting flue which conducts the room air, which has flown into the lower space, into the upper space via a section where the fan motor driving the exhaust fan is disposed, then the room air which has flown into the lower space is forcedly flows into the air-conducting flue due to the suction force of the warm air fan acting on the upper surface and the fan motor can be air cooled with this airflow.

In a case where the blast opening is provided in the lower part of the front surface of the outer case as described above, if a thing (an obstacle) which impedes the forward flow of the warm air is placed near the front surface of the heater, there is a fear that the overheating of the obstacle and the overheating of the floor surface may occur. If the warm air collides against the obstacle, part of the warm air gets over the obstacle and flows upward. However, the direction of the flow of the warm air near the floor surface is changed sideways and part of this warm air takes a short route and is sucked in from the lower part of the air intake opening provided in the side plate portion of the outer case. Therefore, if at least one of the side spaces on the two lateral sides within the outer case is provided with a temperature sensor which detects the temperature of the room air which is sucked in from the air intake opening in a position near the lower part of the air intake opening, then a detected temperature of the temperature sensor rises substantially because the warm air takes a short route. As a result, when an obstacle is placed near the front surface of the heater, this can be detected from a change in a detected temperature of the temperature sensor and the occurrence of the overheating of the obstacle or the floor surface can be prevented by reducing the combustion range of the burner or extinguishing the fire of the burner.

Incidentally, it is preferred that in the place where the air intake opening of each side plate of the outer case is provided, a filter which covers the air intake opening is detachably mounted and that a louver member which covers the filter is attached so as to be able to open and close. With this construction, by closing the louver member on a steady basis, the filter is hidden from the sight and the appearance can be kept in good condition and by opening the louver member, it is possible to remove and clean the filter. Thus, maintainability is also improved.

DETAILED DESCRIPTION OF THE PREFERRED EMBODIMENTS

Figure 1:
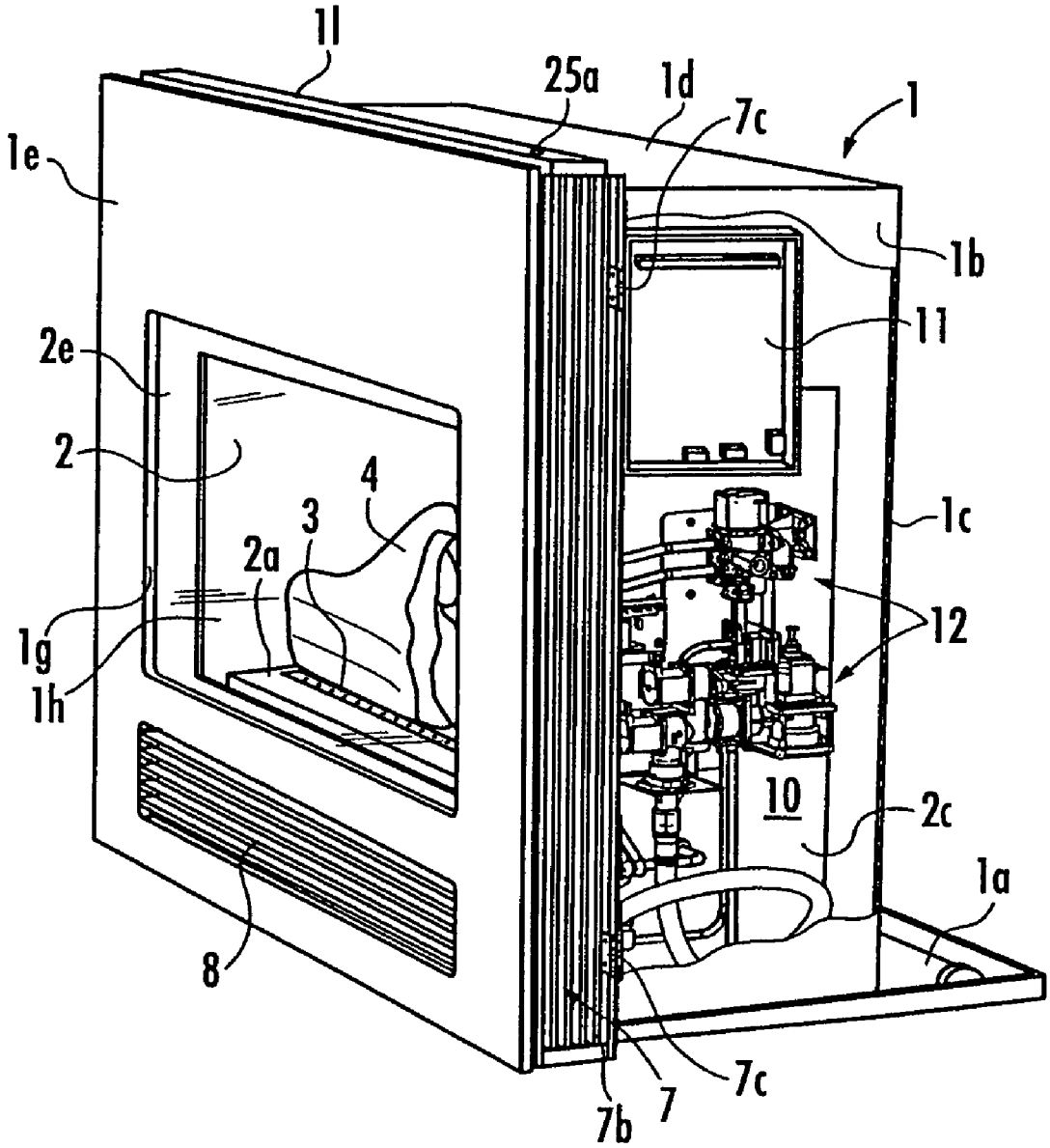
FIG. 1 is a perspective view of a heater in an embodiment of the present invention as viewed on the skew from the front right-hand side of the heater.

Hereinafter, an embodiment in which the present invention is applied to an in-wall fireplace-type heater will be described. As shown in FIGS. 1 to 4, this heater comprises an outer case 1 and a combustion housing 2 provided within the outer case 1. The outer case 1 is constituted by a bottom plate portion 1*a*, right and left side plate portions 1*b*, a back plate portion 1*c*, a top plate portion 1*d*, a front panel 1*e*, and an extension case if which is attached to a left-side part of the back surface of the back plate portion 1*c*. As shown in FIG. 4, the outer case 1 is installed by being embedded in a recess Wa which is formed in a room wall W, and only the front part of the outer case 1 is exposed to the front side of the room wall W.

A burner 3 is disposed in the lower part within the combustion housing 2. A burner supporting plate 2*a* having an opening into which a top end portion of the burner 3 is to be fitted is disposed within the combustion housing 2, and an artificial firewood 4 formed from a refractory material such as ceramics is disposed on the burner supporting plate 2*a*. And a glass plate 2*b* is mounted on the front surface of the combustion housing 2, and a window portion 1*g* facing the glass plate 2*b* is provided in the front panel 1*e* of the outer case 1. Thus, the inside of the combustion housing 2 can be seen with eyes from before the front panel 1*e* and this can give a visual impression as if the artificial firewood 4 were burning when a burner 3 is turned on. Incidentally, it is also possible to form the front panel 1*e* in such a manner that a peripheral edge part of the window portion 1*g* comes into close contact with a peripheral edge part of the front surface of the combustion housing 2. In this embodiment, however, the front panel 1*e* is formed so that the window portion 1*g* is somewhat apart to the front of the combustion housing 2, and a pane 1*h* is mounted on the window portion 1*g*. An air supply duct 5 is connected to the bottom surface of the combustion housing 2, and the outdoor air is forcedly supplied to the inside of the combustion housing 2 via the air supply duct 5 by the suction force of an exhaust fan 14, which will be described later.

There is disposed a heat exchanger 6 which is provided within the outer case 1 so as to be positioned behind the combustion housing 2 and into which combustion exhaust gas from the combustion housing 2 flows via a communication pipe 6*a*. An air intake opening 7 and a blast opening 8 are each provided in the outer case 1, and within the outer case 1, there is disposed a warm air fan 9 which sucks in room air from the air intake opening 7 and sends the air into the room from the blast opening 8 via a section where the heat exchanger 6 is disposed so that the function of heating with warm air can be obtained. To improve the heating efficiency, it is preferred that the warm air be blown out in a position near the floor surface. In this embodiment, therefore, the blast opening 8, which is laterally long, is provided in the lower part of the wind portion 1*g* of the front panel 1*e* of the outer case 1. In order to ensure the cooling performance of the space above the combustion housing 2 within the outer case 1, where the temperature is apt to rise, the warm air fan 9 is disposed in the space above the combustion housing 2. And the room air from the air intake opening 7 which is sucked into the warm air fan 9 is sent to the blast opening 8 via the section where the heat exchanger 6 is disposed and the space below the combustion housing 2. Incidentally, on both right and left outer sides of the combustion housing 2, there are disposed partition plates 2*c*, 2*c* which reach the bottom plate portion 1*a* and back plate portion 1*c* of the outer case 1, whereby the two partition plates 2*c*, 2*c* can prevent the air sent from the warm air fan 9 from escaping sideways. Below the combustion housing 2, there is disposed a guide plate 2*d* which guides the air which has passed through the section where the heat exchanger 6 is disposed to the blast opening 8.

Within the outer case 1, control equipment which comprises an electronic control unit 11 and a valve unit 12 for the burner 3 is disposed so as to be positioned in a side space 10 of one lateral side (right side) between the outer case and the combustion housing 2 (the space between the partition plate 2*c* on the right side of the combustion housing 2 and the side plate portion 1*b* on the right side of the outer case 1), and an exhaust duct 15 connected to an exhaust fan 14 (refer to FIG. 2) in the extension case 1*f* is provided downstream of the heat exchanger 6 in a side space 13 on the other lateral side (left side) between the outer case and the combustion housing 2 (the space between the partition plate 2*c* on the left side of the combustion housing 2 and the side plate portion 1*b* on the left side of the outer case 1). In this case, there is a fear that the temperature of the electronic control unit 11 and the valve unit 12 may rise due to the heat from the combustion housing 2, causing heat loss to the control equipment and, at the same time, there is a fear that the temperature in the side space 13 on the left side may rise due to the heat from the combustion housing 2 and the heat from the exhaust duct 15, causing overheating of the room wall W.

In this embodiment, therefore, in each of the right and left side plate portions 1*b* of the outer case 1, the air intake opening 7, which is vertically long, is provided so as to be positioned in a front side portion exposed to the front side of the room wall W. Thus, each of the side spaces 10, 13 within the outer case 1 provides a ventilation flue on the suction side which conducts the room air from each of the air intake openings 7 to the warm air fan 9, and the room air flows in a wide vertical area of each of the side spaces 10, 13. And each of the side spaces 10, 13 is effectively cooled with this airflow. Therefore, it is possible to positively prevent the overheating of the room wall W due to a temperature rise of the side spaces 10, 13 and the occurrence of heat loss of the electronic control unit 11 and the valve unit 12.

Figure 5:
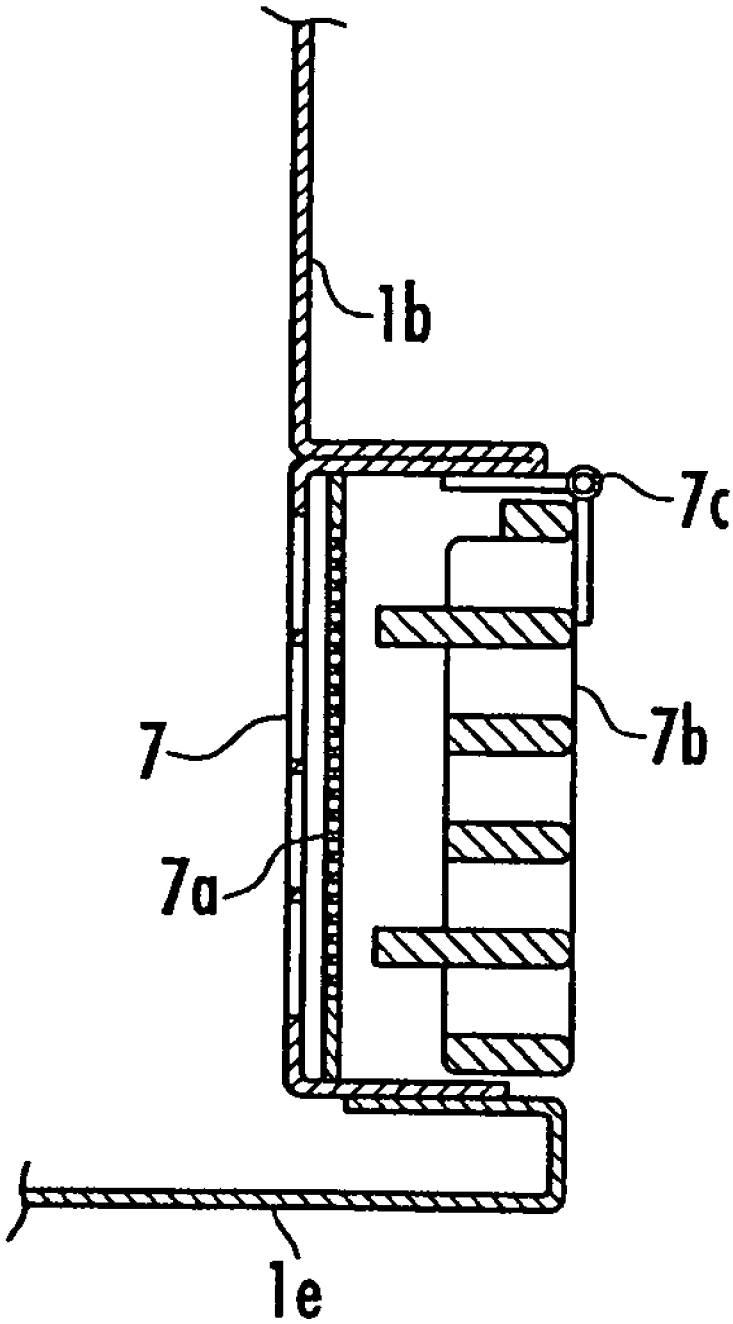
FIG. 5 is an enlarged cutaway plan view of an air intake opening portion of the heater of the embodiment, the heater being cut in a position indicated by the line V-V in FIG. 3.

As shown in FIG. 5, in the place where the air intake opening 7 of each of the side plates 1*b* of the outer case 1 is provided, a filter which 7*a* covers the air intake opening 7 is detachably mounted, and a louver member 7*b* which covers the filter 7*a* is attached so as to be able to open and close by use of a hinge 7*c* in one of the front and rear edge portions, for example, in the rear edge portion. Thus, the entry of dust from the air intake opening 7 is prevented and at the same time, the filter 7*b* is hidden from the sight by closing the louver member 7*b* on a steady basis and the appearance can be kept in good condition. And by opening the louver member 7*b*, it is possible to remove and clean the filter 7*a* and maintainability is also improved.

Figure 3:
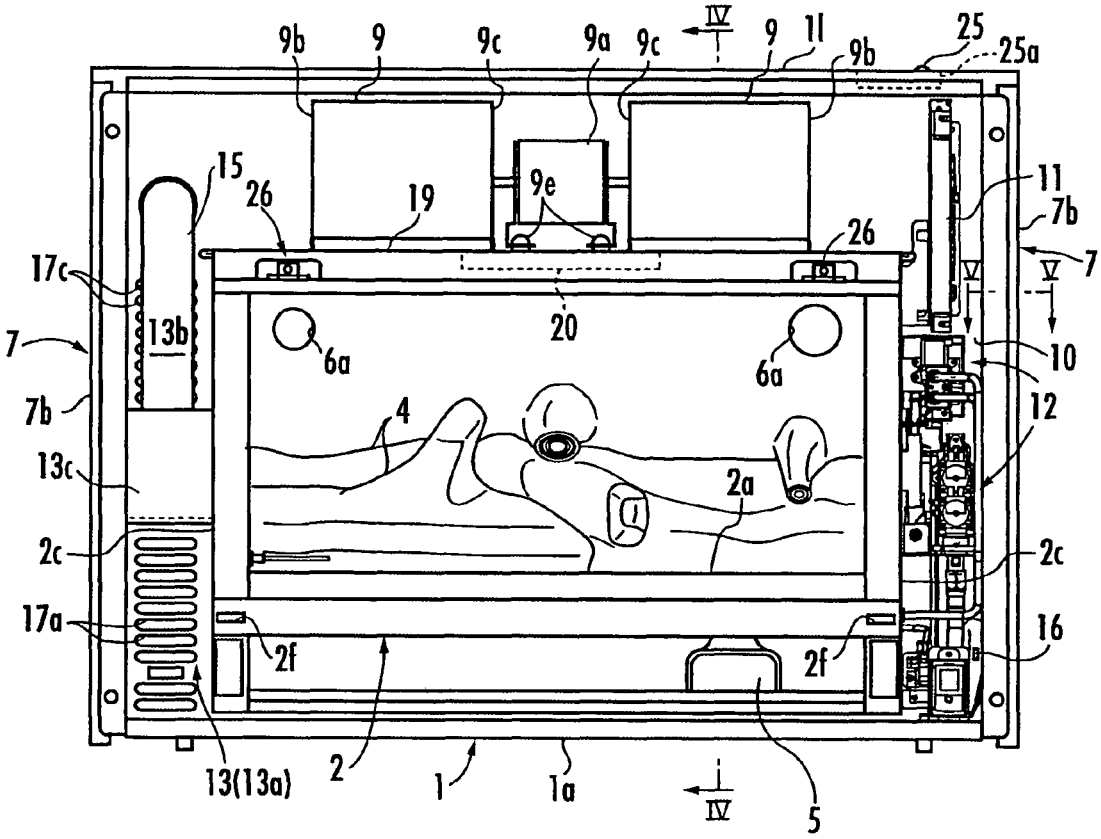
FIG. 3 is a front view of the heater of the embodiment when a front panel and a front door of a combustion housing are removed.
Figure 4:
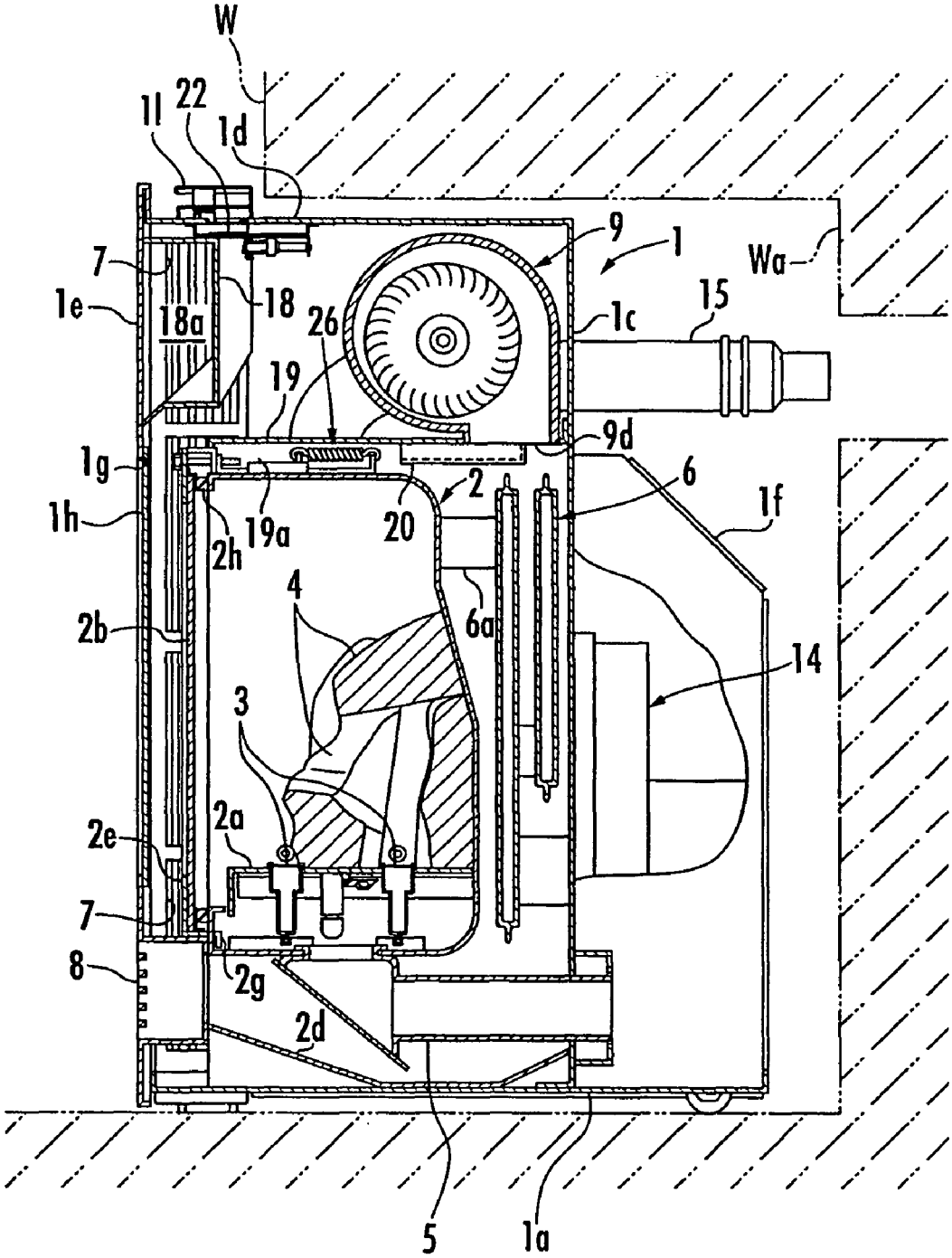
FIG. 4 is a cut away side view of the heater of the embodiment, the heater being cut in a position indicated by the line IV-IV in FIG. 3.

And in at least one of the side spaces, for example, the side space 10 on the right side, there is provided as shown in FIG. 3 a temperature sensor 16 which detects the temperature of the room air which is sucked in from the air intake opening 7 so as to be positioned near the lower part of the air intake opening 7. In a case where the blast opening 8 is provided in the lower part of the front panel 1*e* of the outer case 1 as described above, if a thing (an obstacle) which impedes the forward flow of the warm air is placed near the front surface of the heater, there is a fear that the overheating of the obstacle and the overheating of the floor surface may occur. If the warm air collides against the obstacle, part of the warm air gets over the obstacle and flows upward. However, the direction of the flow of the warm air near the floor surface is changed sideways and part of this warm air takes a short route and is sucked in from the lower part of the air intake opening 7 provided in the side plate portion 1*b* of the outer case 1. And a detected temperature of the temperature sensor 16 rises substantially because the warm air takes a short route like this. As a result, when an obstacle is placed near the front surface of the heater, this can be detected from a change in a detected temperature of the temperature sensor 16 and the occurrence of the overheating of the obstacle or the floor surface can be prevented by reducing the combustion range of the burner 3 or extinguishing the fire of the burner 3.

Figure 2:
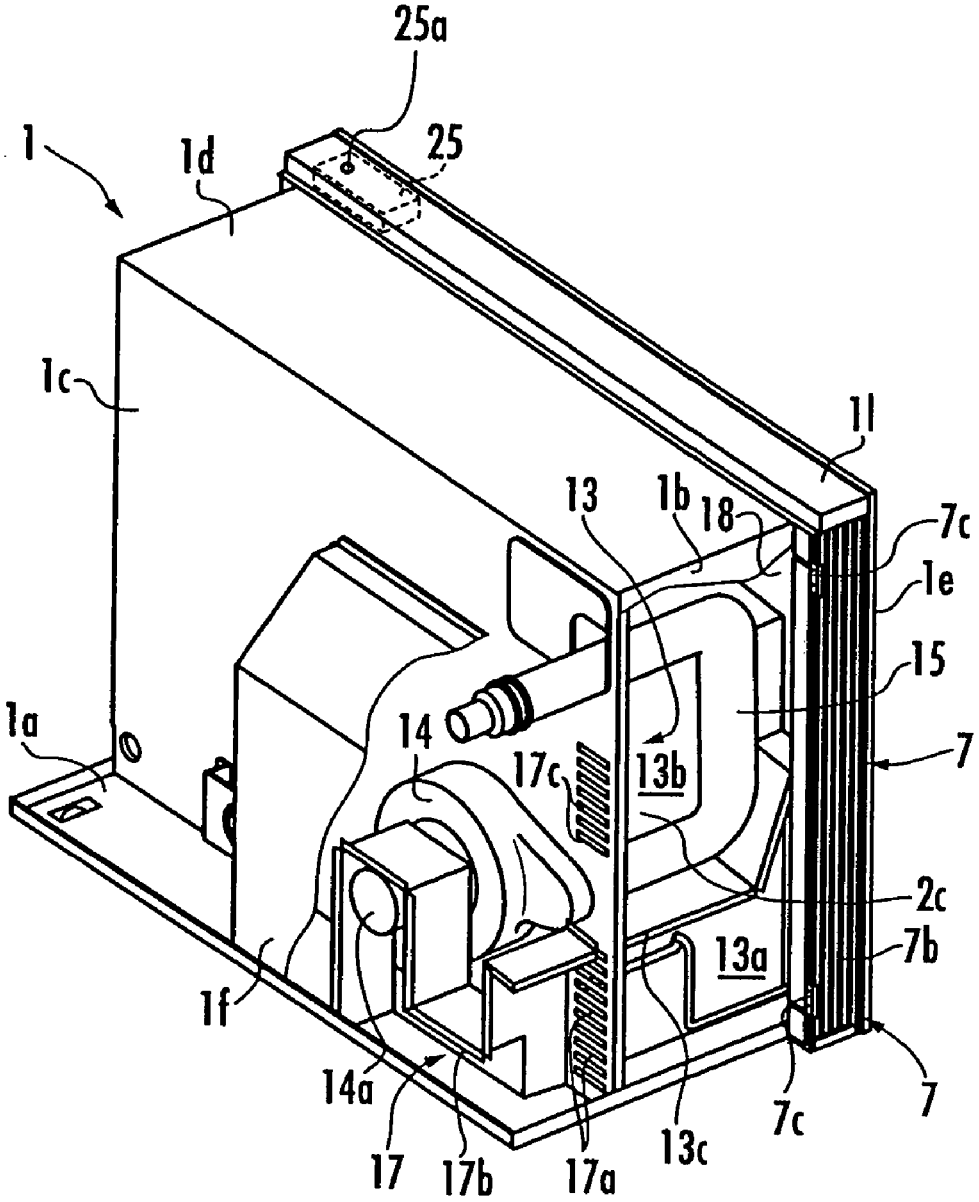
FIG. 2 is a perspective view of the heater of the embodiment as viewed on the skew from the upper back left-hand side of the heater.

As shown in FIG. 2, the side space 13 on the left side within the outer case 1 is partitioned by a partition plate 13*c* into a lower space 13*a* below the exhaust duct 15 and an upper space 13*b* where the exhaust duct 15 is disposed. And there is provided an air-conducting flue 17 which conducts the air which has flown into the lower space 13*a* into the upper space 13*b* via a section where a fan motor 14*a* for the exhaust fan 14 disposed in the extension case 1*f* is disposed. The air-conducting flue 17 is constituted by a first ventilation opening 17*a* which faces the lower space 13*a* formed in the back plate portion 1*c* of the outer case 1, an air guide member 17*b* within the extension case if which conducts the air from the first ventilation opening 17*a* to the section where the fan motor 14*a* is disposed, and a second ventilation opening 17*c* which faces the upper space 13*b* formed in the back plate portion 1*c* of the outer case 1. With this construction, the air which has been conducted by the air guide member 17*b* from the first ventilation opening 17*a* to the section where the fan motor 14*a* is disposed, passes through the section where the fan motor 14*a* is disposed, and flows forward toward the outer surface of the exhaust fan 14, whereby the air cooling of the fan motor 14*a* is performed. Thus, the heat loss to the fan motor 14*a* due to the heat of the combustion exhaust gas is prevented. Also, the air which has passed through the section where the fan motor 14*a* is disposed, flows from within the extension case 1*f* into the upper space 13*b* via the second ventilation opening 17*c*, and is sucked into the warm air fan 9.

Incidentally, it is also conceivable that in the front panel 1*e* of the outer case 1, the air intake opening 7 is provided on the two right and left outer sides of the window portion 1*g*. With this construction, however, the front panel 1*e* gives a complicated impression with many openings and the appearance worsens. At the same time, a sucked-in sound generated when the room air it sucked in form the air intake opening 7 is radiated directly to the front of the heater and the noise becomes large. On the other hand, when the air intake opening 7 is provided in the side plate portion 1*b* of the outer case 1*b* as in this embodiment, the front panel 1*e* gives a neat impression and the appearance is improved. At the same time, the sucked-in sound is radiated sideways to the heater and the noise level of the sucked-in sound before the heater decreases.

The warm air fan 9 is constituted by a sirocco fan which sucks in air from the axial direction. The shaft length of the warm air fan 9 cannot be made very large in terms of strength. The lateral dimension of the heater of this embodiment is as large as nearly 90 cm. Therefore, in the space above the combustion housing 2, a pair of right and left units of the warm air fan 9 is juxtaposed in such a posture that the axial direction of each unit is laterally aligned, and a common fan motor 9*a* which drives the two warm air fans 9, 9 is disposed between the two warm air fans 9, 9. The greater part of the room air which has flown into each of the side spaces 10, 13 within the outer case 1 is sucked into each of the warm air fans 9 from a suction opening 9*b* at an outer end thereof in the axial direction. And part of the room air which has flown in from each of the air intake openings 7 is sucked into each of the warm air fans 9 from the suction opening 9*c* at an inner end thereof in the axial direction after passing through the gap between the front surface of the combustion housing 2 and the front panel 1*e* and the space above the combustion housing 2.

Figure 6:
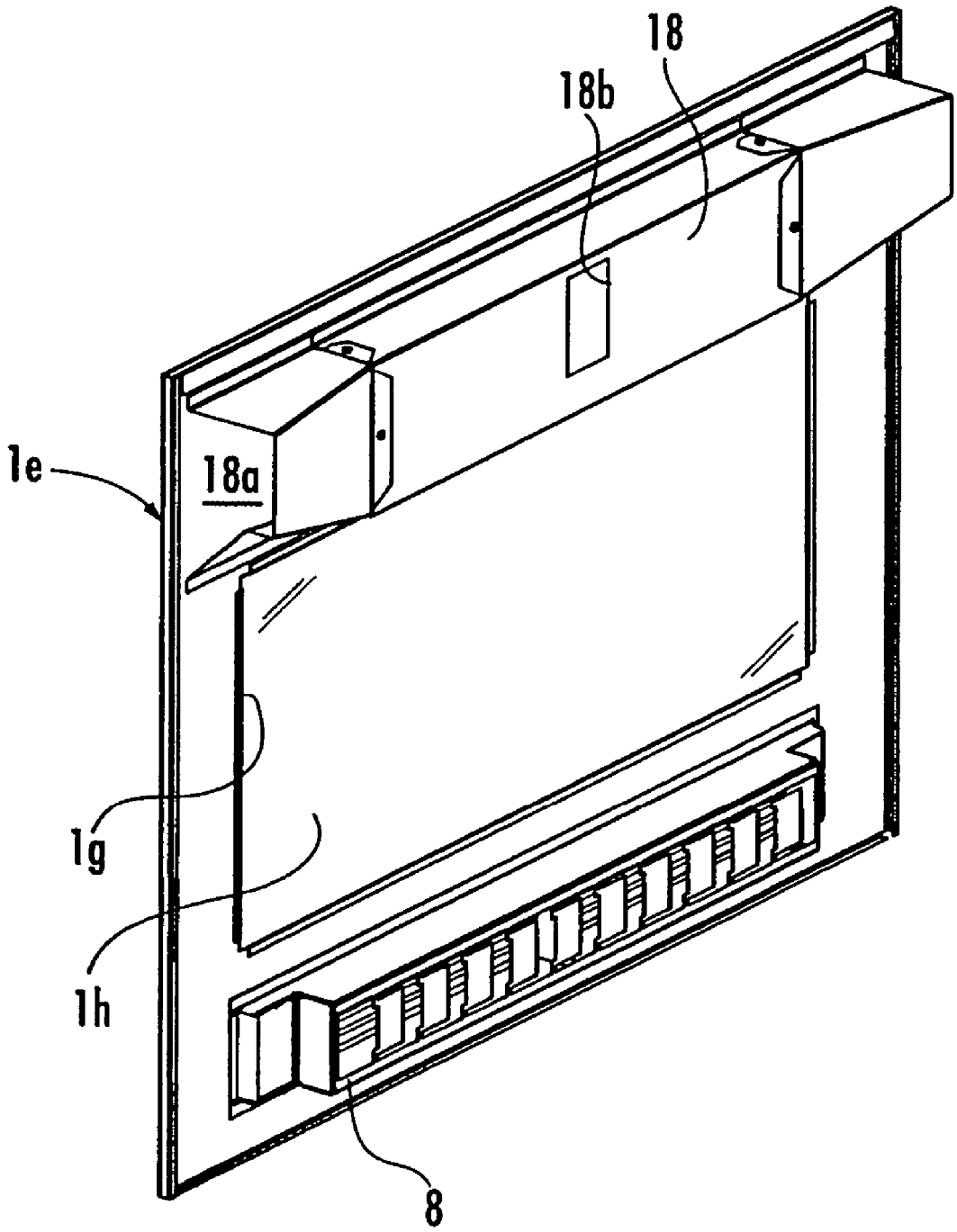
FIG. 6 is a perspective view of a front panel of the heater of the embodiment, as viewed on the skew from the back side of the front panel.

As shown in FIG. 6, on the back surface of the front panel 1*e* of the outer case 1, there is provided a duct 18 which is laterally long and defines a ventilation flue 18*a* between the front panel 1 and the duct 18 so as to be positioned on the upper side of the window portion 1*g*. Both lateral end portions of the duct 18 are in communication with the upper parts of the right and left air intake openings 7, 7. An air outlet 18*b* is provided in the duct 18 so as to be positioned in a part near the fan motor 9*a* for the warm air fan 9, i.e., in the lateral middle part of the duct 18.

With this construction, the room air from the upper parts of the right and left air intake openings 7 passes through each of the right and left halves of the duct 18, then passes from the air outlet 18*b* through the section where the fan motor 9*a* is disposed, and is sucked into each of the warm air fans 9 from a suction opening 9*c* at an inner end in the axial direction thereof. Therefore, the panel portion of the front panel 1*e* on the upper part of the window portion 1*g* is air cooled with the room air which flows through the duct 18, and even when users touch this panel portion, they do not feel the heat. Although the space above the combustion housing 2 is a place in which the temperature conditions are severe to the fan motor 9*a*, the air from the air outlet 18*b* of the duct 18 flows to the section where the fan motor 9*a* is disposed. Therefore, the fan motor 9*a* is effectively air cooled and the heat loss of the fan motor 9*a* does not occur.

Incidentally, in order to positively prevent the heat loss of the fan motor 9*a*, it is necessary to suppress also the heat transfer to the fan motor 9*a* from the combustion housing 2. Therefore, above the combustion housing 2, there is disposed a partition plate 19 which defines a gap 19*a* between a top surface of the combustion housing 2 and the partition plate 19, the gap 19*a* being in communication with the section where the heat exchanger 6 is disposed, and the pair of right and left warm air fans 9, 9 and the fan motor 9*a* are mounted on this partition plate 19. And by causing at least part of the air blown out of each of the warm air fans 9 to flow via the gap 19*a* into the section where the heat exchanger 6 is disposed, the partition plate 19 is air cooled so that the heat transfer to the fan motor 9*a* from the combustion housing 2 is suppressed.

Figure 7:
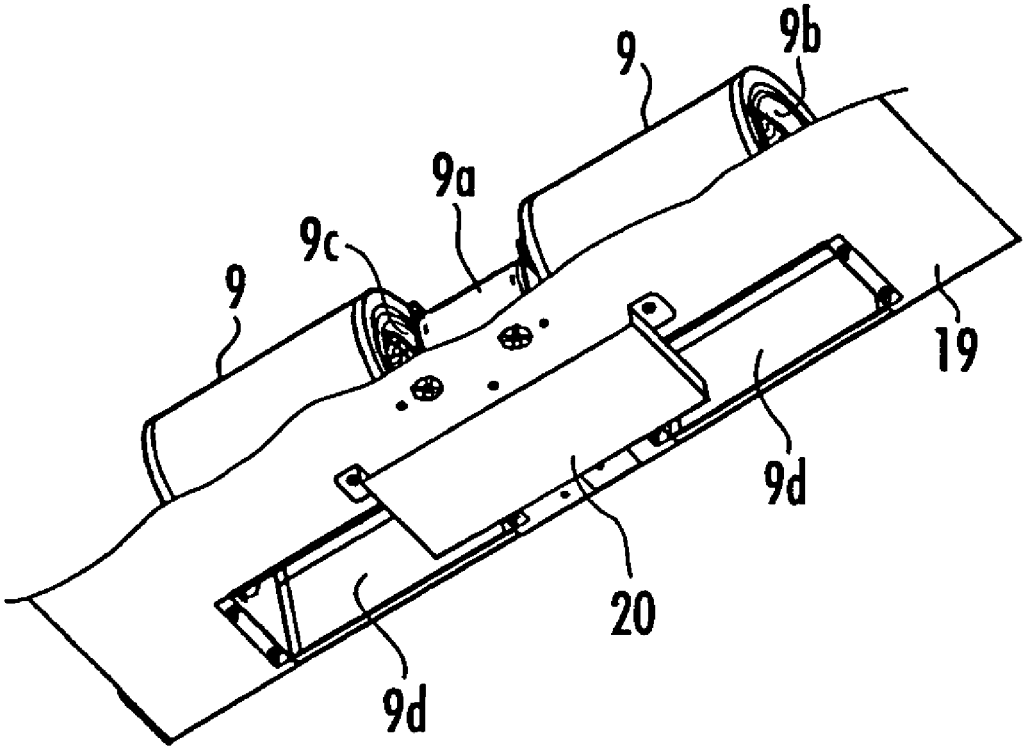
FIG. 7 is a perspective view of a section where a warm air fan is disposed in the heater of the embodiment, as viewed on the skew from below.

It is also conceivable that each of the warm air fans 9 is mounted on the partition plate 19 so that an outlet 9*d* of the warm air fan 9 is opposed to the top surface of the combustion housing 2 and that the whole volume of the air blown out of the warm air fan 9 is caused to flow via the gap 19*a* to the section where the heat exchanger 6 is disposed. With this construction, however, the pressure loss in the gap 19*a* increases and the air volume of the warm air sent from the blast opening 8 into the room decreases. In this embodiment, therefore, each of the warm air fans 9 is mounted on the partition plate 19 in such a manner that the outlet 9*d* of the warm air fan 9 faces a part immediately above the section where the heat exchanger 6 is disposed, and as shown in FIG. 7, a split-flow plate 20 which conducts part of the air blown out of the outlet 9*d* of each of the warm air fans 9 into the gap 19*a* is provided on the bottom surface of the partition plate 19. With this construction, the pressure loss in the gap 19*a* decreases and a decrease in the air volume of the warm air can be prevented. Incidentally, the split-flow plate 20 is disposed on the bottom surface of the partition plate 19 in the place where the fan motor 9*a* is disposed, in such a manner that both lateral end portions of the split-flow panel 20 face end portions of the outlet openings 9*d*, 9*d* of the right and left warm air fans 9, 9 on the fan motor 9*a* side. For this reason, part of the air blown out of the two warm air fans 9, 9 is guided by the split-flow plate 20 and flows along the place of the partition plate 19 where the fan motor 9*a* is mounted, and the place where the fan motor 9*a* is mounted is effectively air cooled. Incidentally, although in this embodiment, the fan motor 9*a* is mounted on the partition plate 19 via a mount rubber 9*e*, the thermal deterioration of the mount rubber 9*e* can also be effectively prevented by the air cooling of the partition plate 19.

Incidentally, if the power source becomes off due to a power outlet chord being pulled out or a power failure during the operation of the heater, the warm air fan 9 comes to a standstill, with the result that the temperature within the outer case 1 rises due to the heat release from the combustion housing 2, the heat exchanger 6, etc. even when the combustion of the burner 3 is stopped. In this case, usually, the hot air within the outer case 1 escapes from the air intake opening 7 to the outside and the temperature within the outer case 1 will not rise excessively. However, if the filter 7*a* is clogged, it is impossible to cause the hot air to escape to the outside. In particular, in the case of an in-wall heater, in which the outer case 1 is enclosed with the room wall W and the heat release via the outer case 1 is limited, there is a possibility that the temperature within the outer case 1 may rise excessively, thereby causing heat loss of the electronic control unit 11 etc.

Figure 8A:
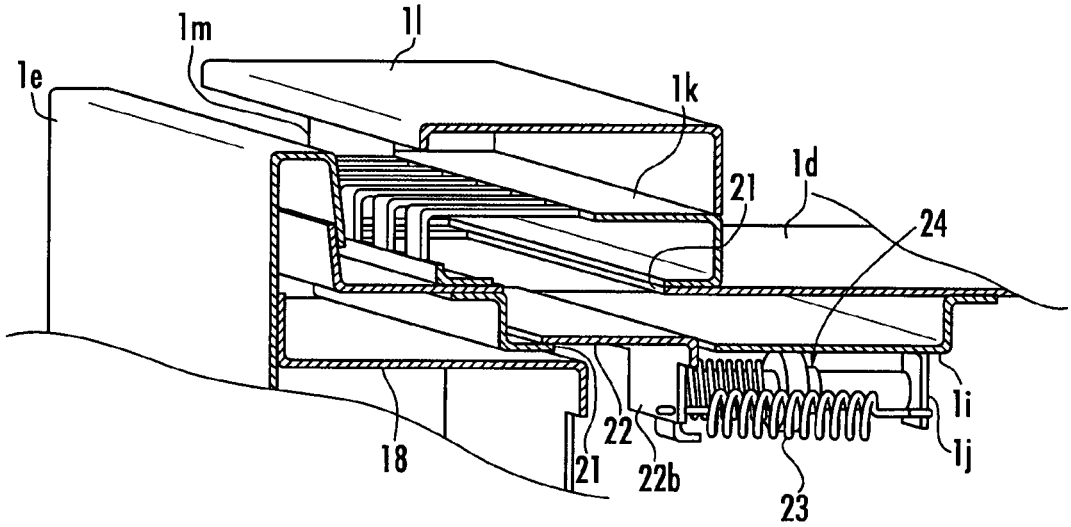
FIG. 8A is a perspective view of a section where a ventilation opening is disposed on a top surface in the heater of the embodiment.
Figure 8B:
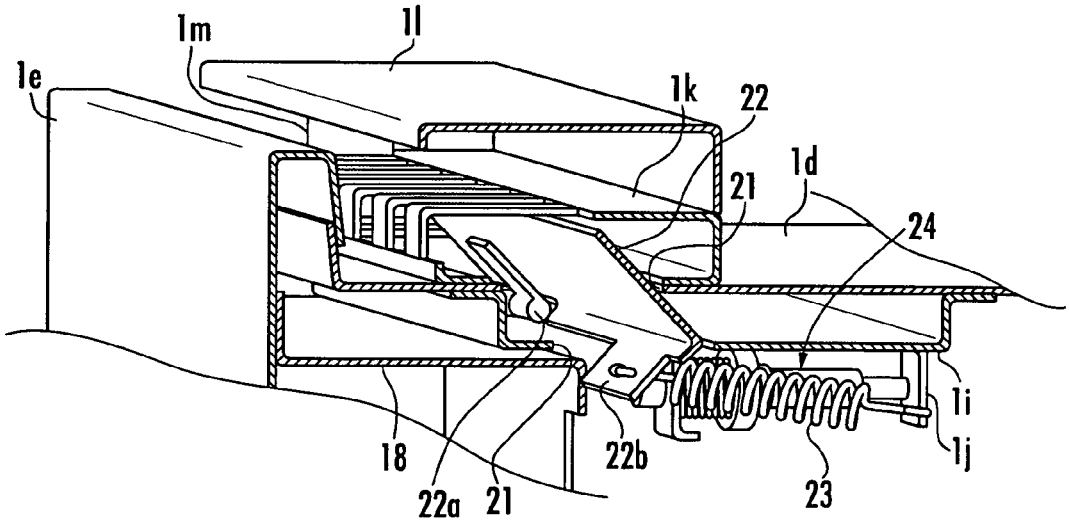
FIG. 8B is a perspective view of a lid member provided in the ventilation opening, the lid member being opened.

In this embodiment, therefore, as shown in FIGS. 8A and 8B, in the top plate portion 1*d* of the outer case 1, a ventilation opening 21 which communicates the inside and outside of the outer case 1 is provided in a front part of the top plate portion 1*d* exposed to the front side of the room wall W so that the hot air within the outer case 1 can be caused to escape to the outside via the ventilation opening 21. In this case, it is also conceivable that a filter is mounted on the ventilation opening 21 in order to prevent the entry of dust into the outer case 1 via the ventilation opening 21. With this construction, however, there is a possibility that the hot air may not be caused to escape from the ventilation opening 21 due to the clogging of the filter. Therefore, the ventilation opening 21 is provided with a lid member 22. The entry of dust from the ventilation opening 21 is prevented by closing the ventilation opening 21 on a steady basis, and only when the temperature within the outer case 1 rises, the lid member 22 is opened and the hot air within the outer case 1 is caused to escape from the ventilation opening 21.

A trough-shaped back plate 1*i* is attached to the bottom surface of the front part of the top plate portion 1*d*. Therefore, the front part of the top plate portion 1*d* becomes a top and bottom double construction formed from the top plate main body and the back plate 1*i*, and the ventilation opening 21 is provided in the top plate main body and the back plate 1*i* in two tiers. And by use of a hinge 22*a*, the lid member 22 is tiltably attached to the back plate 1*i* so that the lid member 22 can assume either the horizontal closed position shown in FIG. 8A, in which the ventilation opening 21 of the lid plate 1*i* is closed, or the obliquely upward open position shown in FIG. 8B, in which the ventilation opening 21 is opened. In the edge portion of the lid member 22 on the hinge 22*a* side, a lever portion 22*b* which bends downward is formed in a bent state. A spring 23 is provided in a tensioned state between this lever 22*b* and a bracket 1*j* provided fixedly on the bottom surface of the back plate 1*i*, and the lid member 22 is urged by the spring 23 to a closed position.

Figure 9:
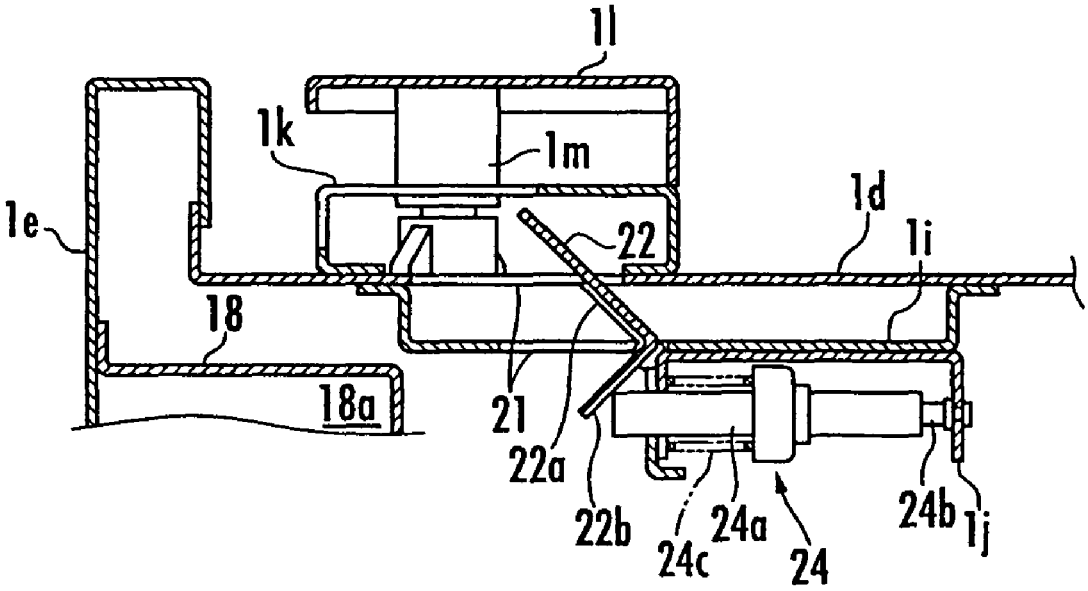
FIG. 9 is a cutaway side view of a section where a ventilation opening is disposed on a top surface in the heater of the embodiment.

As shown in FIG. 9, a wax thermoelement 24, which is a thermomotive member, is attached to the bracket 1*j*. The wax thermoelement 24 is constituted by a cylinder 24*a* in which wax is sealed and a rod 24*b* which is pushed out of the cylinder 24*a* by the thermal expansion of the wax. And the rod 24*b* is connected to an end portion of the bracket 1*j* which is away from the ventilation opening 21, and an end portion of the cylinder 24*a* is slidably inserted into an end portion of the bracket 1*j* near the ventilation opening 21 and is opposed to the lever portion 22*b*. When the temperature within the outer case 1 rises, the cylinder 24*a* is pushed for the rod 24*b* toward the lever portion 22*b* side due to the thermal expansion of the wax, and the lid member 22 becomes opened when the depressing force of the cylinder 24*a* working on the lever portion 22*b* exceeds the urging force of the spring 23. Thus, when the power source has become off during the operation of the heater and the temperature within the outer case 1 has risen, with the escape of the hot air from the air intake opening 7 kept hindered by the clogging of the filter 7*a*, the lid member 22 is opened by the wax thermoelement 24 and the hot air within the outer case 1 escapes from the ventilation opening 21 to the outside. Therefore, the temperature within the outer case 1 does not rise excessively and the heat loss of the electronic control unit 11 is prevented. Also, because on a steady basis, the lid member 22 is urged by the spring 23 to a closed position and held in this position, the lid member 22 will not rattle due to vibrations during the operation of the heater and the occurrence of an unusual sound by the rattling of the lid member 22 is also prevented.

Incidentally, once the wax thermoelement 24 has stretched, it does not contract even when the temperature drops. For this reason, a spring 24*c* which urges the wax thermoelement 24 in the contracting direction is externally attached to the wax thermoelement 24. However, the spring 24*c* can be omitted if the spring force of the spring 23 for the lid member 22 is set somewhat strong. Also, a guard member 1*k* which prevents the fall of foreign matter by covering the ventilation opening 21 from above is provided on the top surface of the front part of the top plate portion 1*d*, and a top cover 11 which hides the guard member 1*k* and the ventilation opening 21 from the sight is placed via a spacer 1*m*. Furthermore, an operation board 25 comprising an operation switch 25*a* and various inspection switches is provided in the right portion of the front part of the top plate portion 1*d*. The ventilation opening 21 is provided by avoiding the section where the operation board 25 is disposed. The operation board 25 is covered with the top cover 11, and only the operation switch 25*a* is exposed to above through a hole formed in the top cover 11.

Incidentally, in this embodiment, the wax thermoelement 24 is used as a thermomotive member which is deformed by the heat for opening the lid member 22. However, it is also possible that the thermomotive member is formed from a bimetal, a shape-memory alloy, etc.

The above-described glass plate 2*b* of the front surface of the combustion housing 2 is mounted on a front door 2*e* which is detachably attached to the front surface of the main body of the combustion housing 2 so that the maintenance of the burner 3 within the combustion housing 2 can be performed, with the front door 2*e* detached. This front door 2*e* is engaged to engagement holes 2*f* (refer to FIG. 3), which are formed in the bottom end part of the two right and left side portions of the front surface of the main body of the combustion housing 2, in such a manner that the front door 2*e* can tilt in a fore-and-aft direction at claw pieces 2*g* (refer to FIG. 4) provided in a protruding manner in the bottom end part of the two right and left side portions of the front door 2*e*. Also, a pair of right and left urging means 26 for the front door 2*e* is provided on the top surface of the combustion housing 2. And the top end portion of the front door 2*e* is urged backward by use of the urging means 26 so that the front door 2*e* is brought into close contact with the front surface of the main body of the combustion housing 2 via packing 2*h* attached to the back surface of the front door 2*e*.

Figure 10:
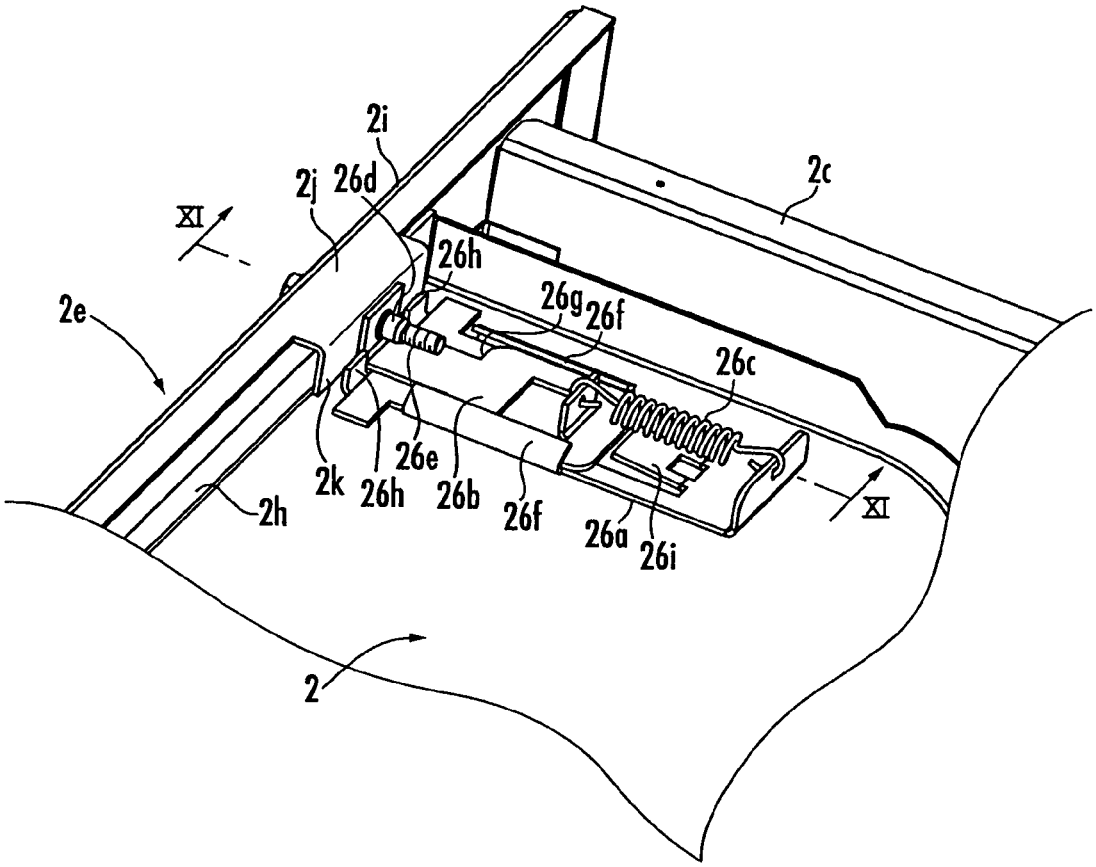
FIG. 10 is a perspective view which shows urging means for the front door of the combustion housing in the heater of the embodiment.
Figure 11:
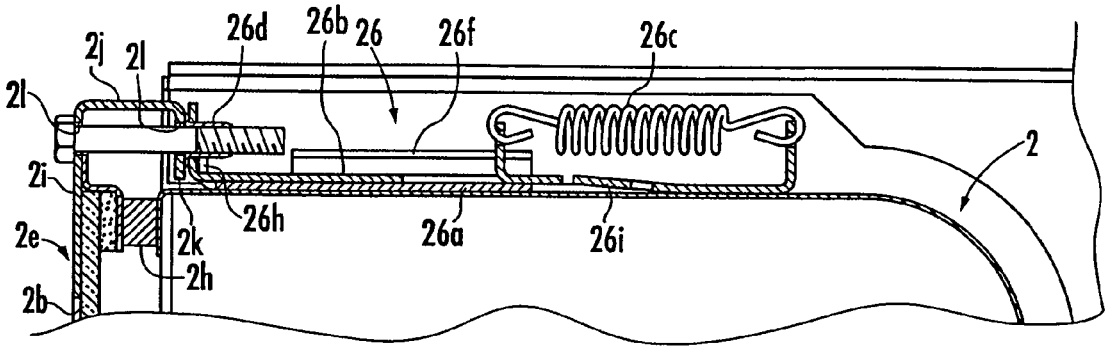
FIG. 11 is a cutaway side view, cut along the line XI-XI of FIG. 10.

As shown in FIGS. 10 and 11, each of the urging means 26 is constituted by a bracket 26*a* which is fixed to the top surface of the combustion housing 2, a slider 26*b* which is movably supported by the bracket 26*a* in a fore-and-aft direction, and a spring 26*c* which is provided in a tensioned state between the back end of the bracket 26*a* and the back end of the slider 26*b* and urges the slider 26*b* backward. The slider 26*b* is in the form of a plate, and a nut 26*d* is crimped to an upward bent portion formed at the front end of the slider 26*b*. And a bolt 26*e*, which passes from the front into a place opposed to each of the urging means 26 in the top end portion of the front door 2*e*, is screwed into the nut 26*d* at the front end of the slider 26*b* and the slider 26*b* is caused to slide closer forward, whereby the spring 26*c* is stretched. With this construction, the top end portion of the front door 2*e* is urged backward via the slider 26*b* by the tensile reaction force of the spring 26*c*.

If the glass plate 2*b* is fixed to the front surface of the combustion housing 2, in the case of explosion and ignition within the combustion housing 2, there is a possibility that the glass plate 2*b* may be broken by an abrupt increase in the inner pressure of the combustion housing 2. On the other hand, in this embodiment, when the inner pressure of the combustion housing 2 increases due to explosion and ignition, the front door 2*e* tilts forward against the urging force of the urging means 26, with the claw pieces 2*g* at the bottom end which engage with the engagement holes 2*f* serving as points of support. As a result of this, a gap is produced between the combustion housing 2 and the front door 2*e*, and the high-pressure gas within the combustion housing 2 escapes from this gap and the breakage of the glass plate 2*b* is prevented.

The slider 26*b* is supported in such a manner that the slider 26*b* does not move laterally or to above due to a bent-back portion 26*f* formed in both side portions of the bracket 26*a* although it moves in a fore-and-aft direction. And because the top end portion of the front door 2*e* is connected to this slider 26*b* via the bolt 26*e*, lateral vibrations of the front door 2*e* do not occur. Therefore, separate stabilization means for preventing lateral vibrations of the front door 2*e* become unnecessary and a cost reduction can be achieved by simplifying the construction.

A shoulder portion 26*g* is formed in the middle part of the fore-and-aft direction of the side edges of the slider 26*b*. And at the front end of the bracket 26*a*, there is provided an advance stopper portion 26*h* which engages with the shoulder portion 26*g* and restricts thereby the forward movement of the slider 26*b* in a prescribed position. This prescribed position is set at such a position that the top end portion of the front door 2*e* connected to the slider 26*b* via the bolt 26*e* does not abut against the front panel 1*e*. Thus, the phenomenon that the front door 2*e* tilts forward forcibly during explosion and ignition and the top end portion of the front door 2*e* collides against the front panel 1*e* can be positively prevented even when the gap between the combustion housing 2 and the front panel 1*e* in the fore-and-aft direction is not very wide.

The bracket 26*a* is provided with a backward movement stopper portion 26*i* which abuts against the back end of the slider 26*b* and restricts the backward movement of the slider 26*b* in a prescribed position. Therefore, in attaching the front door 2*e*, it is possible to prevent the slider 26*b* initially from moving away greatly to behind the top end portion of the front door 2*e* and the stroke until the slider 26*b* is caused to slide closer to the front door 2*e* from becoming excessive. However, if the bolt 26*e* is simply inserted into the top end portion of the front door 2*e*, the bolt 26*e* tilts and it becomes difficult to screw the bolt 26*e* into the slider 26*b* (the nut 26*d*) even when the slider 26*b* is not very away to behind the tail end portion of the front door 2*e*. Therefore, as shown in FIG. 11, the place of the top end portion of the front door 2*e* where the bolt is inserted is formed in the shape of an inverted-U in section, which has a front plate portion 2*i*, a top plate portion 2*j* which extends backward from the top end of the front plate portion 2*i*, and a back plate portion 2*k* which extends downward from the back end of the top plate portion 2*j*, and a bolt insertion hole 21 is formed in the front panel portion 2*i* and the back plate portion 2*k*. With this construction, the bolt 26*e* is supported in the two fore and aft positions of the front plate portion 2*i* and back plate portion 2*k*, the tilt of the bolt 26*e* is suppressed, and the bolt 26*e* can be easily screwed into the slider 26*b*.

Incidentally, if the front door 2*e* is attached by being urged backward by use of the urging means 26, there is a fear that the sealing properties of the front surface of the combustion housing 2 may decrease compared to the front door 2*e* in which the glass plate 2*b* is fixed to the front surface of the combustion housing 2. In this embodiment there is used the exhaust fan 14, in which a fan for forced air supply and exhaust which supplies the outdoor air to the inside of the combustion housing 2 via an air supply channel (the air supply duct 5) and discharges the combustion exhaust gas within the combustion housing 2 to outdoors via an exhaust channel comprising the heat exchanger 6 and the exhaust duct 15. For this reason, the pressure inside the combustion housing 2 becomes a negative pressure due to the suction force of the exhaust fan 14. Therefore, the front door 2*e* is pushed against the front surface of the combustion housing 2 due to the pressure difference inside and outside the combustion housing 2, and the sealing properties of the front surface of the combustion housing 2 do not decrease.

The above descriptions have been given of the embodiment in which the present invention is applied to a fireplace-type in-wall heater in which the inside of the combustion housing 2 can be seen with eyes through the window portion 1*g* provided in the front panel 1*e* of the outer case 1 and the glass plate 2*b* on the front surface of the combustion housing 2. However, the present invention can also be applied to an in-wall warm-air circulator in which the inside of the combustion housing 2 cannot be seen with eyes.

What is claimed is:

1. An in-wall heater which is disposed in a recess formed in room wall, comprising:

an outer casing with top, bottom, front, back and two lateral sides;

a combustion housing which is provided within the outer case and in which a burner is built;

a heat exchanger which is provided within the outer case so as to be positioned behind the combustion housing and causes combustion exhaust gas from the combustion housing to flow;

a plurality of air intake openings and a blast opening each provided in the outer case;

two warm air fans within the outer case which sucks in room air from the air intake opening and sends the air into the room from the blast opening via a section where the heat exchanger is disposed;

control equipment which is disposed in a side space on one lateral side between the outer case and the combustion housing within the case; and an exhaust duct downstream of the heat exchanger which is disposed in a side space on the other lateral side between the outer case and the combustion housing within the case, wherein in a side plate portion of the outer case on both lateral sides, an air intake opening is provided so as to be positioned in a front side portion exposed to the front of the room wall and vertically long, and each of the side spaces within the outer case is formed in a ventilation flue on the suction side where the room air from each of the air intake openings is conducted to the two warm air fans.

2. The in-wall heater according to claim 1, wherein the blast opening is provided in a lower part of the front surface of the outer case and the warm air fan is disposed in a space above the combustion housing within the outer case.

3. The in-wall heater according to claim 2, in which a glass plate is mounted on the front surface of the combustion housing and a window portion facing the glass plate is provided in a front panel composing the front surface of the outer case, wherein a duct is provided on a back surface of a part of the front panel on the upper side of the window portion to be laterally long and define a ventilation flue, which is in communication with an upper part of at least one of the two air intake openings, between the duct and the front panel, and an air outlet is provided in the duct near a section where a fan motor driving the two warm air fans is disposed, and wherein the room air which has been drawn into the duct from the air intake opening is sucked into the two warm air fans after passing through the ventilation flue and the section where the fan motor is disposed in this order.

4. The in-wall heater according to claim 3, wherein the two warm air fans is constituted by a sirocco fan which sucks in air from the axial direction thereof, a pair of right and left warm air fans is juxtaposed in a space above the combustion housing within the outer case in such a posture that the axial direction of each fan is laterally aligned, a common fan motor which drives the two warm air fans is disposed between the two warm air fans, an air outlet is provided in the middle part of the duct in the lateral direction thereof, and two end portions of the duct in the lateral direction thereof are in communication with an upper part of the air intake opening.

5. The in-wall heater according to claim 2, wherein a partition plate is disposed above the combustion housing to define a gap between the partition plate and a top surface of the combustion housing, the gap being in communication with the section where the heat exchanger is disposed, the two warm air fans and a fan motor which drives the warm air fan are mounted on the partition plate, and at least part of air blown out of the warm air fan flows via a gap into the section where the heat exchanger is disposed.

6. The in-wall heater according to claim 5, wherein the mounted on the partition plate in such a manner that an outlet of the warm air fan faces a part immediately above the section where the heat exchanger is disposed, and a split-flow plate which conducts part of the air blown out of the outlet of the warm air fan into the gap is provided on a bottom surface of the partition plate.

7. The in-wall heater according to claim 6, wherein on the partition plate, a pair of right and left warm air fans is mounted in such a posture that the axial direction of each fan is laterally aligned and the common fan motor which drives the two warm air fans is disposed in a position between the two warm air fans, and the split-flow plate is disposed on the bottom surface of the partition plate of the section where the fan motor is mounted with two lateral ends thereof facing end portions of the outlets of the two warm air fans on the fan motor side.

8. The in-wall heater according to claim 2, wherein the exhaust duct is connected to the heat exchanger via an exhaust fan, the side space on the other lateral side within the outer case is partitioned into a lower space below the exhaust duct and an upper space where the exhaust duct is disposed, and an air-conducting flue is provided which conducts the room air, which had been drawn into the lower space, into the upper space via a section where the fan motor driving the exhaust fan is disposed.

9. The in-wall heater according to claim 1, wherein the blast opening is provided in the lower part of the front surface of the outer case, and a temperature sensor which detects the temperature of the room air which is sucked in from the air intake opening is provided in at least one of the side spaces on the two lateral sides within the outer case in a position near the lower part of the air intake opening.

10. The in-wall heater according to claim 1, wherein, a filter which covers the air intake opening is detachably mounted in the place where the air intake opening of each side plate of the outer case is provided and a louver member which covers the filter is attached so as to be able to open and close.

* * * * *